US009709325B2

(12) United States Patent
Chinn et al.

(10) Patent No.: US 9,709,325 B2
(45) Date of Patent: Jul. 18, 2017

(54) INTEGRATION OF A SMALL SCALE LIQUEFACTION UNIT WITH AN LNG PLANT TO CONVERT END FLASH GAS AND BOIL-OFF GAS TO INCREMENTAL LNG

(71) Applicants: Daniel Chinn, Danville, CA (US); Stanley Hsing-Wei Huang, Sugar Land, TX (US); Yaofan Yi, Hercules, CA (US)

(72) Inventors: Daniel Chinn, Danville, CA (US); Stanley Hsing-Wei Huang, Sugar Land, TX (US); Yaofan Yi, Hercules, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 841 days.

(21) Appl. No.: 14/089,329

(22) Filed: Nov. 25, 2013

(65) Prior Publication Data

US 2015/0143843 A1 May 28, 2015

(51) Int. Cl.
*F25J 1/00* (2006.01)
*F25J 1/02* (2006.01)

(52) U.S. Cl.
CPC ..... *F25J 1/0022* (2013.01); *F25J 1/0025* (2013.01); *F25J 1/0242* (2013.01); *F25J 1/0245* (2013.01);
(Continued)

(58) Field of Classification Search
CPC ..... F25J 1/0022; F25J 1/0284; F25J 1/0242; F25J 1/0245; F25J 1/0249; F25J 1/0274;
(Continued)

(56) References Cited

U.S. PATENT DOCUMENTS 5,791,160 A * 8/1998 Mandler ..... F25J 1/0022 62/611
6,367,286 B1 4/2002 Price
(Continued)

FOREIGN PATENT DOCUMENTS

| | | |
|---|---|---|
| AU | 704469 | 9/1997 |
| WO | WO0194865 | 12/2001 |
| WO | WO2009151418 | 12/2009 |

OTHER PUBLICATIONS

Huang S. et al., "BOG recovery from LNG jetties during LNG ship loading", Proceedings. 15th International Conference & Exhibition on Liquefied National Gas: Barcelona, Spain, Apr. 24-27, 2007.the whole document.*

(Continued)

*Primary Examiner* — Frantz Jules
*Assistant Examiner* — Webeshet Mengesha
(74) *Attorney, Agent, or Firm* — Karen R. DiDomenicis

(57) ABSTRACT

Disclosed is a method of retrofitting a full-scale LNG plant to enhance the LNG production capacity of the LNG plant and a method for operating such a retrofit plant. A small scale LNG plant having a capacity less than 2 MTPA can be integrated with a main LNG plant having a capacity of at least 4 MTPA such that end flash gas and boil off gas from the main LNG plant can be liquefied by the small scale LNG plant as incremental LNG. It has been found that the production capacity of the integrated system can be improved by increasing the temperature of the gas stream exiting the main cryogenic heat exchanger of the main LNG plant between 5° C. and 30° C. as compared with the design temperature.

18 Claims, 2 Drawing Sheets

(52) U.S. Cl.
CPC ..... *F25J 1/0249* (2013.01); *F25J 1/0271* (2013.01); *F25J 1/0274* (2013.01); *F25J 1/0284* (2013.01); *F25J 2220/62* (2013.01); *F25J 2230/60* (2013.01); *F25J 2240/82* (2013.01); *F25J 2245/02* (2013.01); *F25J 2245/90* (2013.01); *Y10T 29/49716* (2015.01)

(58) Field of Classification Search
CPC .... F25J 1/0271; F25J 2245/90; F25J 2230/60; F25J 2240/82; F25J 2220/62
See application file for complete search history.

(56) References Cited

U.S. PATENT DOCUMENTS

| | | | | |
|---|---|---|---|---|
| 2007/0193303 | A1* | 8/2007 | Hawrysz | F25J 1/0271 62/612 |
| 2008/0264076 | A1 | 10/2008 | Price et al. | |
| 2012/0317997 | A1* | 12/2012 | Pozivil | F17C 9/02 62/50.2 |
| 2013/0000340 | A1* | 1/2013 | Takayama | F25B 9/008 62/222 |
| 2014/0345299 | A1* | 11/2014 | Kirk | E21B 43/01 62/53.2 |

OTHER PUBLICATIONS

Schoper G: "Cryogen nitrogen rejection technology for current market developments", GASTECH2011, Mar. 22, 2011, the whole document.

Huang S. et al., "BOG recovery from LNG jetties during LNG ship loading", Proceedings. 15$^{th}$ International Conference & Exhibition on Liquefied National Gas: Barcelona, Spain, Apr. 24-27, 2007.the whole document.

* cited by examiner

INTEGRATION OF A SMALL SCALE LIQUEFACTION UNIT WITH AN LNG PLANT TO CONVERT END FLASH GAS AND BOIL-OFF GAS TO INCREMENTAL LNG

FIELD

The present disclosure relates to a process and system for producing liquefied natural gas in which end flash gas and boil off gas produced in a main liquefied natural gas plant are converted to liquefied natural gas using a small-scale liquefaction unit.

BACKGROUND

Many liquefied natural gas (LNG) plants have seasonal fluctuations in production capacity, with higher production potential during the colder months of the year and lower production potential during the warmer months of the year. One reason for the reduced production during warmer months is that since ambient temperature is higher, the density of the air fed to gas turbines used in the liquefaction process is reduced, and thus turbine efficiency and power output are reduced. Another reason for the reduced production is that since ambient temperature is higher, the vapor pressures of all refrigerants used increase so that refrigerant vapors must be compressed at higher pressure, imposing a greater horsepower load on the refrigerant circuit. The opposite effects are observed during the colder months. Another process aspect which can significantly impact the designed plant capacity is the varying richness of feed gas. Typically more power is required to separate natural gas liquids (NGL) from a rich gas stream. All of the facilities involved with producing LNG therefore need to be sized and designed to accommodate all conditions between the minimum production (e.g., summer) and maximum production (e.g., winter) operating cases. Such facilities include upstream facilities, e.g., wells, inlet separators, dehydration units, gas processing facilities and natural gas liquids removal facilities, liquefaction facilities, e.g., main cryogenic heat exchangers, refrigeration loops, and supporting utilities, e.g., gas turbine generators, and downstream facilities, e.g., nitrogen rejection units, end flash gas handling and LNG storage units. An ongoing challenge is to develop new systems and processes to enhance LNG production year-round, in a way that minimizes capital investment, operating costs, added equipment footprint, and significant modifications to the main LNG plant.

Small-scale liquefaction units, also referred to as "packaged" liquefaction units or small-scale LNG plants, having a capacity of less than 2 MTPA (million tons per annum) have been developed. An example is the PRICO® single-mixed refrigerant process available from Black & Veatch (Overland Park, Kans.), disclosed in PCT Publication No. WO 2009/151418. It would be desirable to apply such small-scale liquefaction units to produce incremental LNG in tandem with a full-scale LNG plant having a capacity of at least 4 MTPA. However, a pretreated gas stream fed from the upstream gas processing facilities of the full-scale LNG plant to the small-scale liquefaction unit requires significant refrigeration in order to be liquefied. Furthermore, a pretreated gas stream fed from the upstream gas processing facilities of the full-scale LNG plant to the small-scale liquefaction unit may require separate natural gas liquids removal facilities.

It would be desirable to apply a small-scale liquefaction unit to enhance the LNG production of a full-scale LNG plant in a way that avoids the aforementioned disadvantages. There is a large economic incentive for even small capacity improvements.

SUMMARY

In one aspect, a method is provided for retrofitting a main LNG plant having a capacity of at least 4 MTPA to expand the capacity of the main LNG plant. The main LNG plant includes a main cryogenic heat exchanger having a feed gas inlet and a gas outlet, a nitrogen rejection unit having an inlet in fluid communication with the gas outlet of the main cryogenic heat exchanger, an LNG outlet and an end flash gas outlet, an LNG storage unit having an LNG inlet in fluid communication with the LNG outlet of the nitrogen rejection unit, an LNG storage unit outlet and a boil off gas outlet. The method includes the steps of connecting a small-scale LNG plant having a capacity of less than 2 MTPA and having at least one inlet and an outlet to the end flash gas outlet of the nitrogen rejection unit of the main LNG plant such that an inlet of the small-scale LNG plant and the end flash gas outlet are in fluid communication; and installing at least a first compressor having a first compressor inlet between the end flash gas outlet of the main LNG plant and the inlet of the small-scale LNG plant in fluid communication with the end flash gas outlet for increasing end flash gas pressure prior to being delivered to the inlet of the small-scale LNG plant.

In another aspect, a method is provided for operating the main LNG plant retrofit as described above. The main LNG plant has design parameters including a design capacity, a design total refrigeration duty range, a design production of end flash gas, a design production of boil off gas, a design feed flow rate and a design temperature of a gas stream exiting the main cryogenic heat exchanger. The method for operating the plant includes the steps of passing a natural gas feed stream at a feed flow rate above the design feed flow rate of the main LNG plant through the main cryogenic heat exchanger of the main LNG plant to produce a gas stream exiting the main cryogenic heat exchanger having a temperature between 5° C. and 30° C. higher than the design temperature; sending the gas stream exiting the main cryogenic heat exchanger to a nitrogen rejection unit to produce a nitrogen reduced LNG stream and an end flash gas stream; sending the nitrogen reduced LNG stream to an LNG storage unit; and compressing at least a portion of the end flash gas stream to produce a compressed end flash gas stream and sending the compressed end flash gas stream to the small scale LNG plant to be liquefied. The total refrigeration duty remains within the design total refrigeration duty range.

In another aspect, a system is provided for producing liquefied natural gas. The system includes a main LNG plant having a capacity of at least 4 MTPA and having a main cryogenic heat exchanger having a feed gas inlet and a gas outlet; a nitrogen rejection unit having an inlet in fluid communication with the gas outlet of the main cryogenic heat exchanger, an LNG outlet and an end flash gas outlet; and an LNG storage unit having an LNG inlet in fluid communication with the LNG outlet of the nitrogen rejection unit, an LNG storage unit outlet and a boil off gas outlet. The system further includes an end flash gas compressor connected to the end flash gas outlet; a boil off gas compressor connected to the boil off gas outlet; and a small scale LNG plant having a capacity less than 2 MTPA and having an end flash gas inlet connected to the end flash gas compressor and having a boil off gas inlet connected to the boil off gas compressor.

DESCRIPTION OF THE DRAWINGS

These and other objects, features and advantages of the present invention will become better understood with reference to the following description, appended claims and accompanying drawings where:

DETAILED DESCRIPTION

Figure 1:
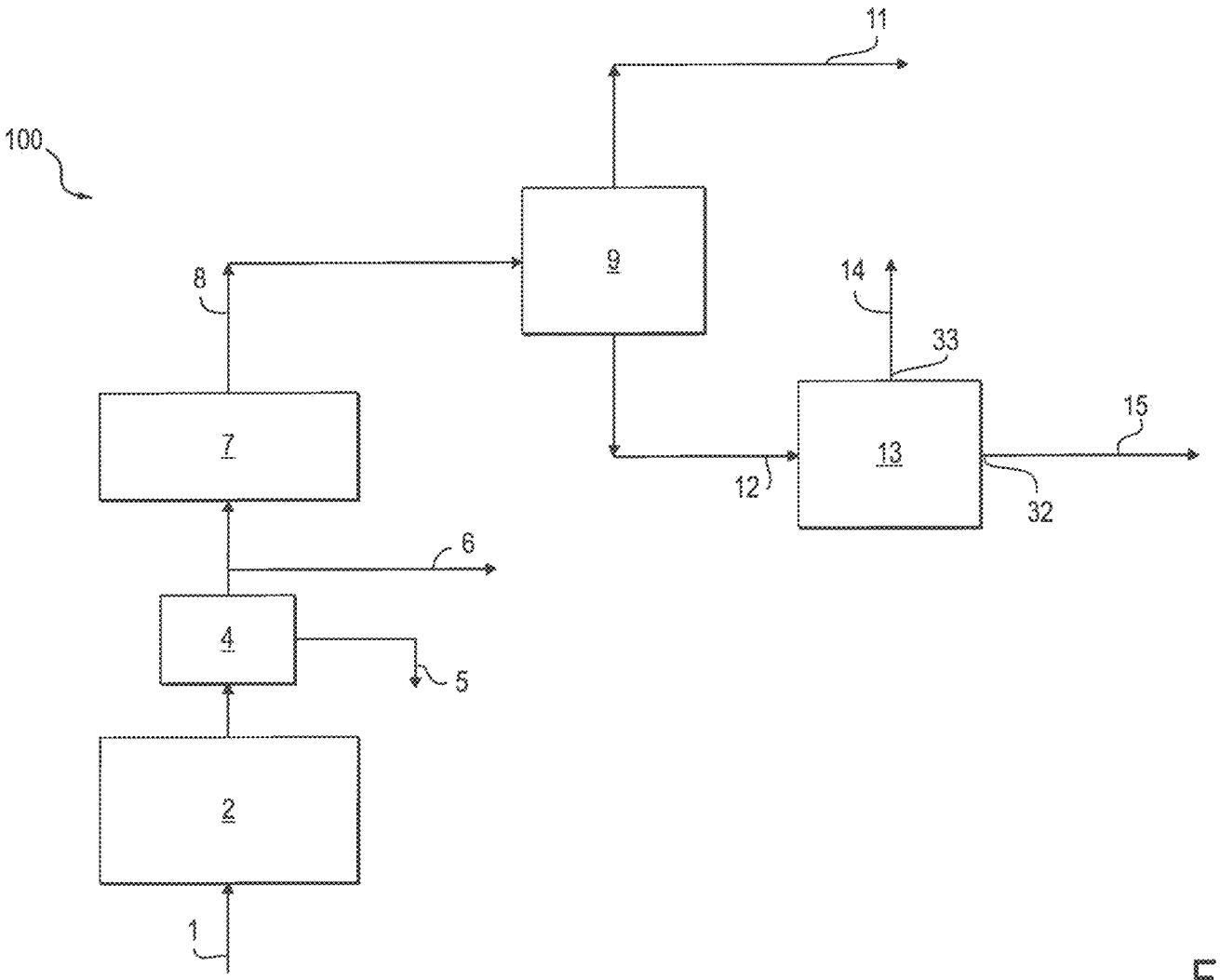
FIG. 1 (Prior Art)
FIG. 1 is a schematic diagram illustrating a main LNG plant for producing liquefied natural gas according to the prior art.

FIG. 1 is a schematic block diagram illustrating a main LNG plant 100 also referred to herein as the base case for producing liquefied natural gas according to the prior art. The main LNG plant according to the prior art typically includes a main cryogenic heat exchanger (MCHE) 7, a nitrogen rejection unit (NRU) 9 in fluid communication with the main cryogenic heat exchanger 7, an LNG storage unit 13 in fluid communication with the nitrogen rejection unit 9. The LNG storage unit 13 further has an LNG storage unit outlet 32 and a boil off gas (BOG) outlet 33. The main LNG plant 100 typically further includes a natural gas liquids removal unit 5 connected upstream of the main cryogenic heat exchanger 7.

Raw natural gas 1 first goes through a series of upstream facilities to first prepare the gas for liquefaction. These processes can include an acid gas removal unit 2 connected upstream of the main cryogenic heat exchanger 7 in which an amine solution may be used to remove $CO_2$ and $H_2S$, a molecular sieve dehydration unit (not shown) to remove $H_2O$, a mercury removal unit (not shown), and a scrub column (not shown) to remove the aromatic compounds benzene, toluene, ethylbenzene, and xylene (BTEX).

A fractionation train also referred to as a natural gas liquids removal unit 4, connected downstream of the acid gas removal unit 2 and upstream of the main cryogenic heat exchanger 7, can be used to produce ethane, propane, and butane as separate streams that may be used for refrigerant makeup, blending into LNG product for heat control, or sold as product, either as segregated streams or mixed as natural gas liquids (NGL) 5.

The gas entering the liquefaction section 7 of the plant will contain mostly methane, nitrogen, and small amounts of ethane and higher. A gas stream 6 can be diverted at this point for use as fuel gas as needed. In the liquefaction section 7, the gas can be pre-chilled by propane and then refrigerated using mixed refrigerant to temperatures of about −150° C. This cold gas then goes through an expansion step which may drop the temperature to −160° C., at which point it may be referred to as subcooled gas.

The subcooled gas then goes through a nitrogen rejection step in the NRU 9 which can be either a series of flash drums or a nitrogen rejection column. A nitrogen-rich end flash gas (EFG) is produced overhead in the NRU and a methane-rich liquid stream is produced and pumped to be stored in LNG storage unit 13 which can be one or more cryogenic tanks. In LNG storage unit 13 the conditions are maintained at about 1 atm and −160° C. The liquid in these tanks is referred to as LNG and may be pumped to LNG tankers for export. While in storage, some of the vapor above the LNG liquid will naturally accumulate and need to be vented from the tank. This gas is referred to as boil-off gas (BOG). In typical LNG plants, the total fuel requirements needed to support the production of mechanical work, electrical power, and heating duties is provided by the combustion of a combination of end flash gas, boil-off gas, and a small slipstream of the treated, raw natural gas.

Figure 2:
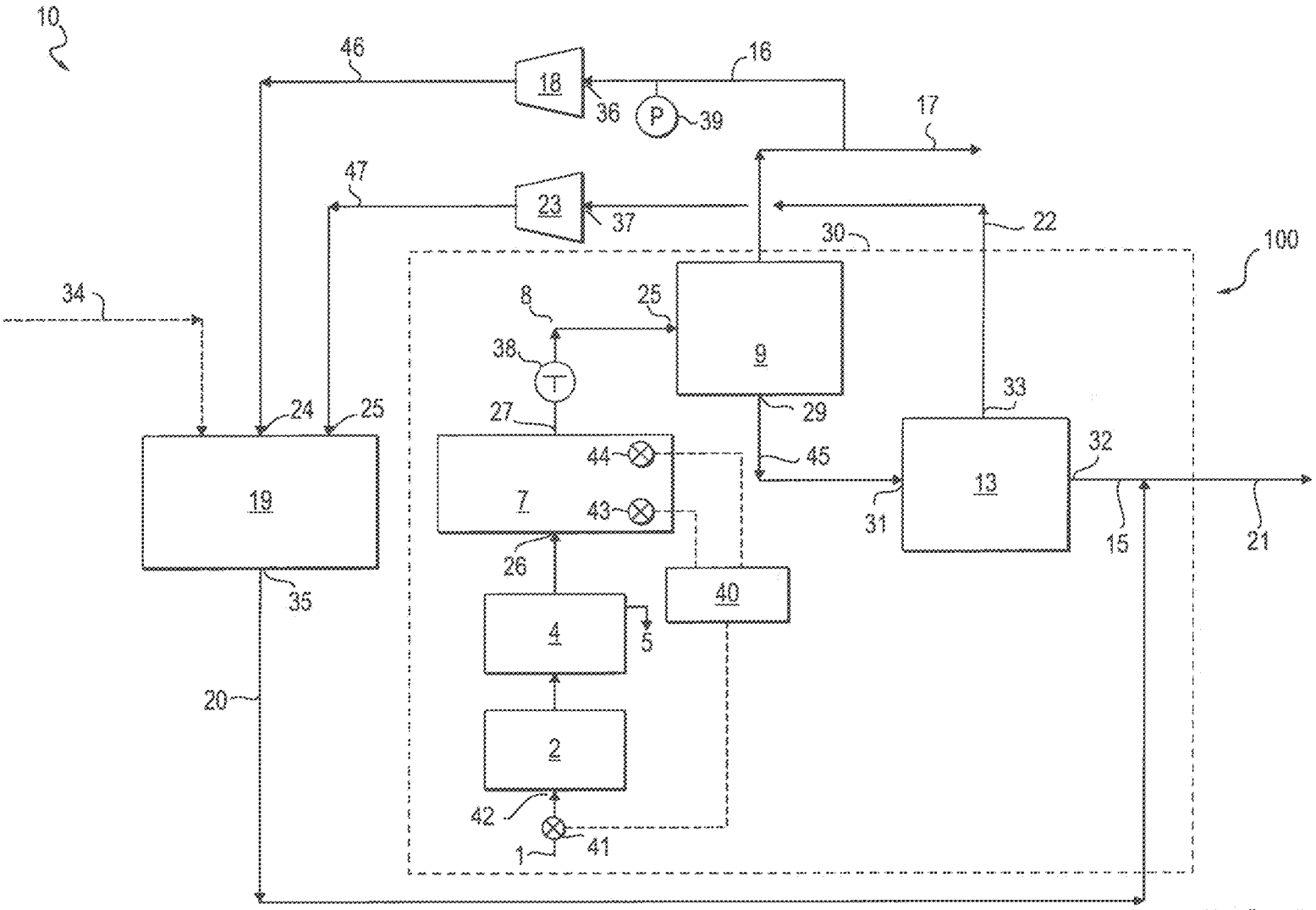
FIG. 2 is a schematic diagram illustrating a system for producing liquefied natural gas according to one exemplary embodiment.

FIG. 2 illustrates a system 10 also referred to as a retrofit LNG plant 10 according to one embodiment of the present disclosure for producing liquefied natural gas also referred to herein as LNG. The system 10 includes a small scale liquefaction unit 19 also referred to as a small-scale LNG plant used in tandem with the components of a main LNG plant 100 to provide a capacity expansion of the main LNG plant. The liquefaction processes in the main LNG plant 100 and the small-scale liquefaction unit 19 operate independently and do not share any refrigerant flows.

The main LNG plant 100 may have one or more trains, each train having a capacity of at least 4 MTPA (million tons per annum). The small scale liquefaction unit 19 can have a capacity less than 2 MTPA, even less than 1 MTPA. The main LNG plant 100 includes major process components as known in existing LNG plants. Among these process components is a main cryogenic heat exchanger 7 having a feed gas inlet 26 and a gas outlet 27. A nitrogen rejection unit 9 has an inlet 28 in fluid communication with the gas outlet 27 of the main cryogenic heat exchanger 7, an LNG outlet 29 and an end flash gas outlet 30. An LNG storage unit 13 having an LNG inlet 31 is in fluid communication with the LNG outlet 29 of the nitrogen rejection unit 9. The LNG storage unit 13 further has an LNG storage unit outlet 32 and a boil off gas (BOG) outlet 33. In one embodiment, the main LNG plant 100 further includes a natural gas liquids removal unit 4 connected upstream of the main cryogenic heat exchanger 7. The main LNG plant 100 can further include an acid gas removal unit 2 connected upstream of the main cryogenic heat exchanger 7 and upstream of the natural gas liquids removal unit 4.

According to one embodiment, an end flash gas compressor 18 is connected to the end flash gas outlet 30. The small scale LNG plant 19 has an end flash gas inlet 24 connected to the end flash gas compressor 18. According to another embodiment, a boil off gas compressor 23 is connected to the boil off gas outlet 33. The small scale LNG plant 19 has a boil off gas inlet 25 connected to the boil off gas compressor 23.

The small-scale liquefaction unit 19 processes the treated natural gas from the main LNG plant, in the form of end flash gas and optional boil off gas, and converts it to an LNG stream 20 which may be combined with the LNG stream 15 produced by the main LNG plant 100.

Examples of suitable small-scale liquefaction units 19 having a capacity less than 2 MTPA, even about 1 MTPA or less, include PRICO® single-mixed refrigerant process available from Black & Veatch (Overland Park, Kans.), IPSMR® liquefaction process available from Chart Industries (Garfield Heights, Ohio), MiniLNG™ available from Hamworthy Gas Systems AS (Oslo, Norway), LIMUM® process (Linde Multistage Mixed Refrigerant) available from Linde AG (Pullach, Germany), and NicheLNG$^{SM}$ LNG process technology available from ABB Lummus Global's Randall Gas Technologies Division (The Hague, Netherlands). The Micro LNG system available from GE Oil & Gas, a division of General Electric Company (Fairfield, Conn.) is a suitable small-scale liquefaction unit 19 having a capacity of 50-150 kilotons per year. The small-scale liquefaction unit 19 will include a nitrogen rejection unit prior to the heat exchanger. The heat exchanger of the small-scale liquefaction unit can be cooled by a separate, single mixed-refrigerant. The refrigerant compressors can be powered by electric motors using electricity generated from waste heat from the main LNG plant 100.

According to one embodiment, a method for retrofitting a main LNG plant 100, as described above in the description of the base case, having a capacity of at least 4 MTPA to expand the capacity of the main LNG plant 100 is provided. A small-scale LNG plant 19 having at least one inlet 24, 25 and an outlet 35 is connected to the end flash gas outlet 30 of the nitrogen rejection unit 9 of the main LNG plant such that an inlet 24 of the small-scale LNG plant 19 and the end flash gas outlet 30 are in fluid communication. A first compressor 18 having a first compressor inlet 36 is installed between the end flash gas outlet 30 of the main LNG plant and the inlet 24 of the small-scale LNG plant 19 in fluid communication with the end flash gas outlet 30 for increasing end flash gas pressure prior to being delivered to the inlet 24 of the small-scale LNG plant 19. Optionally, the small-scale LNG plant 19 is also connected to the boil off gas outlet 33 of the LNG storage unit 13 of the main LNG plant such that an inlet 25 of the small-scale LNG plant 19 and the boil off gas outlet 33 are in fluid communication. A second compressor 23 having a second compressor inlet 37 is installed between the boil off gas outlet 33 of the main LNG plant and the inlet 25 of the small-scale LNG plant 19 in fluid communication with the boil off gas outlet 33 for increasing boil off gas pressure prior to being delivered to the inlet 25 of the small-scale LNG plant 19.

Advantageously, a temperature sensor 38 can be installed between the gas outlet 27 of the main cryogenic heat exchanger 7 of the main LNG plant and the inlet 28 to the nitrogen rejection unit 9 of the main LNG plant capable of gathering temperature information on a gas stream exiting the main cryogenic heat exchanger 7 of the main LNG plant. According to another embodiment, a pressure sensor 39 can be installed at the first compressor inlet 36 capable of gathering pressure information on a gas stream entering the first compressor 18.

A processor 40 can be installed in communication with the temperature sensor 38 for receiving the temperature information gathered by the temperature sensor 38, or in communication with the pressure sensor 39 for receiving the pressure information gathered by the pressure sensor 39, and determining whether to activate a change based on the temperature information or the pressure information. Such a change may include a change in a feed gas flow rate of the feed gas 1 to the main cryogenic heat exchanger 7 of the main LNG plant. The processor 40 can be connected to a flow control valve 41 upstream of the feed gas inlet 42 of the of the main LNG plant in order to activate a change in the feed gas flow rate. Alternatively, the processor 40 can be used to determine whether to activate a change in a refrigerant circulation rate within the main cryogenic heat exchanger 7 of the main LNG plant based on the temperature or pressure information. In such case, the processor 40 can be connected to a refrigerant control valve or a refrigerant compression control mechanism 43 associated with the main cryogenic heat exchanger 7 of the main LNG plant. Alternatively, the processor 40 can be used to determine whether to activate a change in a pressure at an outlet of a refrigerant compressor associated with the main cryogenic heat exchanger 7 based on the temperature or pressure information. In such case, the processor 40 can be connected to a compressor outlet valve 44.

According to one embodiment, a method for operating the main LNG plant retrofit as described above is provided. A natural gas feed stream 1 is passed at a feed flow rate above the design feed flow rate, i.e., the feed flow rate as specified by the base case plant design, of the main LNG plant 100 through the main cryogenic heat exchanger 7 of the main LNG plant to produce a gas stream 8 exiting the main cryogenic heat exchanger having a temperature between 5° C. and 30° C. higher than the design temperature, i.e., the temperature of this stream as specified by the base case plant design. According to one embodiment, the design temperature of the gas stream 8 exiting the main cryogenic heat exchanger 7 is in a range of from −135° C. to −150° C. and the gas stream 8 exiting the main cryogenic heat exchanger 7 has an actual temperature in a range of from −120° C. to −140° C.

According to one embodiment, the temperature of gas stream 8 exiting the main cryogenic heat exchanger can be monitored with a temperature sensor 38 as described previously herein. At least one process condition can be controlled to result in maintaining the temperature of the gas stream 8 exiting the main cryogenic heat exchanger 7 at a temperature between 5° C. and 30° C. higher than the design temperature. Such process conditions can include feed gas flow rate to the main cryogenic heat exchanger of the main LNG plant, refrigerant circulation rate within the main cryogenic heat exchanger of the main LNG plant, pressure at an outlet of a refrigerant compressor associated with the main cryogenic heat exchanger, and combinations thereof.

The gas stream 8 exiting the main cryogenic heat exchanger 7 is sent to a nitrogen rejection unit 9 to produce a nitrogen reduced LNG stream 45 and an end flash gas stream 16. The nitrogen reduced LNG stream 45 is sent to an LNG storage unit 13. At least a portion of the end flash gas stream 16 is compressed to produce a compressed end flash gas stream 46 which is sent to the small scale LNG plant 19 to be liquefied. Optionally, the BOG stream 22 is compressed to produce a compressed BOG stream 47 which is sent to the small scale LNG plant 19 to be liquefied. The optimum pressure of the end flash gas and BOG streams will be determined per project requirements.

Advantageously, the total refrigeration duty of the retrofit plant remains within the design total refrigeration duty range. By "design total refrigeration duty range" is meant the total refrigeration duty range specified by the base case plant design.

According to one embodiment, the end-flash gas and BOG production are increased as compared with the base case. This is achieved by allowing the temperature of the gas stream 8 leaving the main cryogenic heat exchanger 7 to increase prior to the nitrogen rejection unit 9. The increased amount of end-end flash gas from the nitrogen rejection unit 9 may be split between fuel gas 17 and a feed gas 16 to send to the small-scale liquefaction unit 19. The fuel gas stream 17 can be utilized in the main LNG plant 100 and/or the small-scale LNG plant 19. Production of the end flash gas stream 16 is 5-50% by volume, even 10-20% by volume, higher than the design production of end flash gas, i.e., the production of end flash gas specified by the base case plant design. Likewise, production of the boil off gas stream 22 is 5-50% by volume, even 10-20% by volume, higher than the design production of boil off gas, i.e., the production of BOG specified by the base case plant design. This additional gas is liquefied by the small scale LNG plant 19 to produce incremental LNG 20. As a result, the retrofit LNG plant 10 is utilized at a capacity above the design capacity, i.e., the capacity of the base case plant 100 as designed.

According to one embodiment, incremental LNG 20 produced by the small scale LNG plant 19 advantageously contains no natural gas liquids. Thus the small scale liquefaction unit 19 will not need to provide additional NGL recovery. The end-flash gas and BOG streams 47 and 46 are clean gas streams as compared with the treated natural gas fed to the main cryogenic heat exchanger 7 of the main LNG plant 100.

Running the MCHE 7 temperature higher also decreases the refrigeration horsepower requirement in the main LNG plant 100. As a result, the main LNG plant 100, including all units upstream and downstream of the MCHE 7, may be utilized fully, i.e., at full design capacity year-round. Additionally, in some embodiments, some of the sweet gas in the main LNG plant 100 can be diverted from use as supplemental fuel gas into feed gas for the main plant's liquefaction unit 7, since lower overall refrigeration requirements can result in lower total fuel consumption.

The main LNG plant 100 may have one or more trains, each train having a capacity of at least 4 MTPA (million tons per annum). The main LNG plant can be, for example, a three-train LNG plant wherein each LNG train can use a gas turbine, such as a Frame 7 or a Frame 9 gas turbine available from General Electric Company (Fairfield, Conn.), to provide mechanical work to drive the refrigeration compressors in the liquefaction section 7. In the base case plant design, waste heat recovery units (WHRU) can be installed on each gas turbine to capture heat to be used to provide heating duties for various plant power users, e.g., helper motors, pumps, air cooling fans, electric-driven compressors, etc. In the base case plant design, there is no need for heating duties or power not provided for, and the hot flue-gas exhaust from the gas turbines is typically vented without heat recovery.

In one embodiment, the small-scale liquefaction unit 19 can be powered completely by electric motors (not shown). The PRICO® single-mixed refrigerant process as the small-scale liquefaction unit 19 requires about 45 megawatts (MW) of power per 1 MTPA of incremental LNG capacity. The electricity 34 required to power the small-scale liquefaction unit 19 can be provided from various waste heat sources in the main LNG plant 100. For example, waste heat can be obtained from the hot flue-gas exhaust from the power generation gas turbines in the utility section of the main LNG plant which is typically vented without heat recovery. Waste heat can also be obtained from various sources of process waste heat in the main LNG plant as well such as compression exhaust. Technologies for converting waste heat to power are known in the art. These include adding a steam cycle and turbine in tandem with a gas turbine (combined cycle), or the use of Organic Ranking Cycle (ORC) such as the ORegen™ system offered by General Electric.

In one embodiment, the main LNG plant 100 has a temperature control system for controlling the temperature of the gas stream 8 exiting the main cryogenic heat exchanger 7. A temperature sensor 38 can be located between the gas outlet 27 of the main cryogenic heat exchanger 7 of the main LNG plant and the inlet 28 to the nitrogen rejection unit 9 of the main LNG plant capable of gathering temperature information on a gas stream exiting the main cryogenic heat exchanger 7 of the main LNG plant. A processor 40 in communication with the temperature sensor can receive the temperature information gathered by the temperature sensor 38 and determine whether to activate a change in at least one process condition to result in maintaining the temperature of the gas stream 8 exiting the main cryogenic heat exchanger 7 at a temperature between 5° C. and 30° C. higher than the design temperature. The at least one process condition can be selected from the group consisting of feed gas flow rate to the main cryogenic heat exchanger 7 of the main LNG plant, refrigerant circulation rate within the main cryogenic heat exchanger 7 of the main LNG plant, and pressure at an outlet of a refrigerant compressor associated with the main cryogenic heat exchanger 7.

It should be noted that only the components relevant to the disclosure are shown in the figures, and that many other components normally part of an LNG plant are not shown for simplicity.

EXAMPLES

Base Case

The base case LNG plant 100 as described previously and shown in FIG. 1 was assumed to have 3 trains at 5 MTPA per train. The base case LNG plant design was based on average ambient temperature design, and the difference between winter design and ambient design was assumed to be 4.5%. Therefore every piece of equipment in the upstream sections of the main LNG plant, i.e., the AGRU, NGL removal, etc. and in the small-scale liquefaction unit 19, was assumed to have margin for at least 4.5%. Other LNG plants may have a different design margin difference between average ambient and the winter ambient.

All BOG and end flash gas 11 was assumed to be used as fuel gas. The product and stream flow values were inferred from heat and material balances from a process design.

Example 1

A retrofit LNG Plant 10 as described previously and shown in FIG. 2 was assumed to have a main LNG plant 100 having 3 trains at 5.225 MTPA per train and a small-scale liquefaction unit 19 having 1 train at 1 MTPA capacity. All BOG 22 and a portion of the end flash gas 16 were assumed to be sent to the small-scale liquefaction unit 19 for incremental LNG production. The remaining end flash gas is used for fuel 17.

Table 1 summarizes the total product gas and fuel gas for the base case and Example 1.

TABLE 1

| Product and Stream Flows (kg-mole/hr) | base case | Example 1 |
|---|---|---|
| LNG to Shipping | 113,298 | 118,396 |
| Condensate to Shipping | 842 | 880 |
| Domestic Gas Export | 13,806 | 14,427 |
| $CO_2$ to Injection | 11,512 | 12,030 |
| BOG Gas | 3,302 | 4,181 |
| Sweet gas diverted to HP Fuel | 2,895 | 0 |
| End Flash Gas | 10,365 | 13,126 |
| Total Flows | 156,020 | 163,041 |

The upstream sections of the main LNG plant can process 4.5% of the natural gas feed 1 more than the base case. At the same time, the main LNG plant's liquefaction section 7 can process 100% of the natural gas, propane, and mixed refrigerant loads. The small-scale liquefaction unit 19 is sized to process the extra 4.5% natural gas increment along with the associated refrigeration loads, which are separate from those of the main LNG plant 100. As a result, the retrofit LNG Plant 10 (Example 1) can produce 4.5% more LNG as compared with the base case.

Where permitted, all publications, patents and patent applications cited in this application are herein incorporated by reference in their entirety, to the extent such disclosure is not inconsistent with the present invention.

Unless otherwise specified, the recitation of a genus of elements, materials or other components, from which an individual component or mixture of components can be selected, is intended to include all possible sub-generic combinations of the listed components and mixtures thereof. Also, "comprise," "include" and its variants, are intended to be non-limiting, such that recitation of items in a list is not to the exclusion of other like items that may also be useful in the materials, compositions, methods and systems of this invention.

From the above description, those skilled in the art will perceive improvements, changes and modifications, which are intended to be covered by the appended claims.

What is claimed is:

1. A method for retrofitting a main LNG plant having a capacity of at least 4 MTPA to expand the capacity of the main LNG plant and operating the expanded capacity plant, wherein the main LNG plant has design parameters including a winter design capacity, an average ambient temperature design capacity, a refrigeration horsepower requirement, a design production of end flash gas, a design production of boil off gas, a design feed flow rate and a design temperature of a gas stream exiting a main cryogenic heat exchanger and wherein the main LNG plant comprises a main cryogenic heat exchanger having a feed gas inlet and a gas outlet, a nitrogen rejection unit having an inlet in fluid communication with the gas outlet of the main cryogenic heat exchanger, an LNG outlet and an end flash gas outlet, an LNG storage unit having an LNG inlet in fluid communication with the LNG outlet of the nitrogen rejection unit, an LNG storage unit outlet and a boil off gas outlet, the method comprising:

connecting a small-scale LNG plant having a capacity of less than 2 MTPA and having at least one inlet and an outlet to the end flash gas outlet of the nitrogen rejection unit of the main LNG plant such that an inlet of the small-scale LNG plant and the end flash gas outlet are in fluid communication;

installing a first compressor having a first compressor inlet between the end flash gas outlet of the main LNG plant and the inlet of the small-scale LNG plant in fluid communication with the end flash gas outlet for increasing end flash gas pressure prior to being delivered to the inlet of the small-scale LNG plant;

passing a natural gas feed stream at a feed flow rate above the design feed flow rate of the main LNG plant through the main cryogenic heat exchanger of the main LNG plant to produce a gas stream exiting the main cryogenic heat exchanger having a temperature between 5° C. and 30° C. higher than the design temperature;

sending the gas stream exiting the main cryogenic heat exchanger to a nitrogen rejection unit to produce a nitrogen reduced LNG stream and an end flash gas stream;

sending the nitrogen reduced LNG stream to an LNG storage unit; and compressing at least a portion of the end flash gas stream to produce a compressed end flash gas stream and sending the compressed end flash gas stream to the small scale LNG plant to be liquefied, thereby decreasing the refrigeration horsepower requirement such that the expanded capacity plant can be utilized at the winter design capacity above the average ambient temperature design capacity year-round.

2. The method of claim 1, further comprising:

connecting the small-scale LNG plant to the boil off gas outlet of the LNG storage unit of the main LNG plant such that one of the at least one inlet of the small-scale LNG plant and the boil off gas outlet are in fluid communication; and installing a second compressor between the boil off gas outlet of the main LNG plant and the inlet of the small-scale LNG plant in fluid communication with the boil off gas outlet for increasing boil off gas pressure prior to being delivered to the inlet of the small-scale LNG plant.

3. The method of claim 1, further comprising:

installing a temperature sensor between the gas outlet of the main cryogenic heat exchanger of the main LNG plant and the inlet to the nitrogen rejection unit of the main LNG plant capable of gathering temperature information on a gas stream exiting the main cryogenic heat exchanger of the main LNG plant.

4. The method of claim 3, further comprising:

installing a processor in communication with the temperature sensor for receiving the temperature information gathered by the temperature sensor and determining whether to activate a change in a feed gas flow rate to the main cryogenic heat exchanger of the main LNG plant; and connecting the processor to a flow control valve upstream of the feed gas inlet of the main cryogenic heat exchanger of the main LNG plant.

5. The method of claim 3, further comprising:

installing a processor in communication with the temperature sensor for receiving the temperature information gathered by the temperature sensor and determining whether to activate a change in a refrigerant circulation rate within the main cryogenic heat exchanger of the main LNG plant; and connecting the processor to a refrigerant control valve or a refrigerant compression control mechanism associated with the main cryogenic heat exchanger of the main LNG plant.

6. The method of claim 3, further comprising:

installing a processor in communication with the temperature sensor for receiving the temperature information gathered by the temperature sensor and determining whether to activate a change in a pressure at an outlet of a refrigerant compressor associated with the main cryogenic heat exchanger; and connecting the processor to a compressor outlet valve.

7. The method of claim 1, further comprising:

installing a pressure sensor at the first compressor inlet capable of gathering pressure information on a gas stream entering the first compressor.

8. The method of claim 7, further comprising:

installing a processor in communication with the pressure sensor for receiving the pressure information gathered by the pressure sensor and determining whether to activate a change in a feed gas flow rate to the main cryogenic heat exchanger of the main LNG plant; and connecting the processor to a flow control valve upstream of the feed gas inlet of the main cryogenic heat exchanger of the main LNG plant.

9. The method of claim 7, further comprising:

installing a processor in communication with the pressure sensor for receiving the pressure information gathered by the pressure sensor and determining whether to activate a change in a refrigerant circulation rate within the main cryogenic heat exchanger of the main LNG plant; and connecting the processor to a refrigerant control valve or a refrigerant compression control mechanism associated with the main cryogenic heat exchanger of the main LNG plant.

10. The method of claim 7, further comprising:

installing a processor in communication with the pressure sensor for receiving the pressure information gathered by the pressure sensor and determining whether to activate a change in a pressure at an outlet of a refrigerant compressor associated with the main cryogenic heat exchanger; and connecting the processor to a compressor outlet valve.

11. The method of claim 1, wherein the design temperature of the gas stream exiting the main cryogenic heat exchanger is in a range of from −135° C. to −150° C. and the gas stream exiting the main cryogenic heat exchanger in step (a) has a temperature in a range of from −120° C. to −140° C.

12. The method of claim 1, wherein prior to step (a), the natural gas stream is treated to remove acid gas and natural gas liquids.

13. The method of claim 1, further comprising:

monitoring the temperature of the gas stream exiting the main cryogenic heat exchanger with a temperature sensor and/or monitoring the pressure of the gas stream entering the first compressor with a pressure sensor; and controlling at least one process condition to result in maintaining the temperature of the gas stream exiting the main cryogenic heat exchanger at a temperature between 5° C. and 30° C. higher than the design temperature.

14. The method of claim 13, wherein the at least one process condition is selected from the group consisting of feed gas flow rate to the main cryogenic heat exchanger of the main LNG plant, refrigerant circulation rate within the main cryogenic heat exchanger of the main LNG plant, and pressure at an outlet of a refrigerant compressor associated with the main cryogenic heat exchanger.

15. The method of claim 1, further comprising utilizing a portion of the end flash gas stream as a fuel gas stream in the main LNG plant and/or the small-scale LNG plant.

16. The method of claim 1, wherein power for the small scale LNG plant is provided by waste heat recovered from a utility section of the main LNG plant.

17. The method of claim 1, wherein production of the end flash gas stream is 5-50% by volume higher than the design production of end flash gas; and production of the boil off gas stream is 5-50% by volume higher than the design production of boil off gas.

18. The method of claim 1, wherein production of the end flash gas stream is 10-20% by volume higher than the design production of end flash gas; and production of the boil off gas stream is 10-20% by volume higher than the design production of boil off gas.

* * * * *